US008012269B2

(12) United States Patent
Yamamoto et al.

(10) Patent No.: US 8,012,269 B2
(45) **Date of Patent: *Sep. 6, 2011**

(54) ND-FE-B RARE EARTH PERMANENT MAGNET MATERIAL

(75) Inventors: Kenji Yamamoto, Echizen (JP); Koichi Hirota, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 291 days.

This patent is subject to a terminal disclaimer.

(21) Appl. No.: 11/315,099

(22) Filed: Dec. 23, 2005

(65) Prior Publication Data

US 2006/0137767 A1 Jun. 29, 2006

(30) Foreign Application Priority Data

Dec. 27, 2004 (JP) ..... 2004-375784

(51) Int. Cl.
*H01F 1/057* (2006.01)

(52) U.S. Cl. ..... 148/302; 148/101; 148/103

(58) Field of Classification Search ..... None
See application file for complete search history.

(56) References Cited

U.S. PATENT DOCUMENTS

| | | | | |
|---|---|---|---|---|
| 4,762,574 | A | 8/1988 | Ghandehari | |
| 5,858,123 | A * | 1/1999 | Uchida et al. | 148/302 |
| 6,296,720 | B1 | 10/2001 | Yamamoto et al. | |
| 6,506,265 | B2 | 1/2003 | Yamamoto et al. | |
| 6,706,124 | B2 | 3/2004 | Kanekiyo et al. | |
| 6,790,296 | B2 | 9/2004 | Kanekiyo et al. | |
| 2002/0007875 | A1 * | 1/2002 | Yamamoto et al. | 148/302 |
| 2004/0051614 | A1 | 3/2004 | Kanekiyo et al. | |

FOREIGN PATENT DOCUMENTS

| | | | |
|---|---|---|---|
| EP | 1 164 599 | | 12/2001 |
| EP | 1 462 531 | A2 | 9/2004 |
| EP | 1 462 531 | A3 | 9/2004 |
| JP | 61-289605 | A | 12/1986 |
| JP | 62-023960 | A | 1/1987 |
| JP | 4-26525 | B2 | 5/1992 |
| JP | 2000-234151 | A | 8/2000 |
| JP | 3264664 | B1 | 12/2001 |
| JP | 2002-75717 | | 3/2002 |
| JP | 2003-178908 | A | 6/2003 |
| JP | 2003-221655 | A | 8/2003 |
| WO | 2005/001855 | A1 | 1/2005 |

OTHER PUBLICATIONS

Japanese Office Action dated Aug. 2, 2006, issued in corresponding Japanese Application No. 2005-370225.

European Search Report dated Nov. 27, 2008, issued in corresponding European patent application No. 05258057.8.

* cited by examiner

*Primary Examiner* — John P Sheehan

(74) *Attorney, Agent, or Firm* — Westerman, Hattori, Daniels & Adrian, LLP

(57) ABSTRACT

A rare earth permanent magnet material is based on an R—Fe—Co—B—Al—Cu system wherein R is at least one element selected from Nd, Pr, Dy, Tb, and Ho, 15 to 33% by weight of Nd being contained. At least two compounds selected from M-B, M-B—Cu and M-C compounds (wherein M is Ti, Zr or Hf) and an R oxide have precipitated within the alloy structure as grains having an average grain size of up to 5 μm which are uniformly distributed in the alloy structure at intervals of up to 50 μm.

11 Claims, No Drawings

ND-FE-B RARE EARTH PERMANENT MAGNET MATERIAL

CROSS-REFERENCE TO RELATED APPLICATION

This non-provisional application claims priority under 35 U.S.C. §119(a) on Patent Application No. 2004-375784 filed in Japan on Dec. 27, 2004, the entire contents of which are hereby incorporated by reference.

TECHNICAL FIELD

This invention relates to Nd—Fe—B base rare earth permanent magnet materials.

BACKGROUND ART

Rare-earth permanent magnets are commonly used in electric and electronic equipment on account of their excellent magnetic properties and economy. Lately there is an increasing demand to enhance their performance.

To enhance the magnetic properties of R—Fe—B based rare earth permanent magnets, the proportion of the $R_2Fe_{14}B_1$ phase present in the alloy as a primary phase component must be increased. This means to reduce the Nd-rich phase as a nonmagnetic phase. This, in turn, requires to reduce the oxygen, carbon and nitrogen concentrations of the alloy so as to minimize oxidation, carbonization and nitriding of the Nd-rich phase.

However, reducing the oxygen concentration in the alloy affords a likelihood of abnormal grain growth during the sintering process, resulting in a magnet having a high remanence Br, but a low coercivity iHc, insufficient energy product (BH)max, and poor squareness.

The inventor disclosed in JP-A 2002-75717 (U.S. Pat. No. 6,506,265, EP 1164599A) that even when the oxygen concentration during the manufacturing process is reduced for thereby lowering the oxygen concentration in the alloy for the purpose of improving magnetic properties, uniform precipitation of ZrB, NbB or HfB compound in a fine form within the magnet is successful in significantly broadening the optimum sintering temperature range, thus enabling the manufacture of Nd—Fe—B base rare earth permanent magnet material with minimal abnormal grain growth and higher performance.

For further reducing the cost of magnet alloys, the inventor attempted to manufacture magnet alloys using inexpensive raw materials having high carbon concentrations and obtained alloys with significantly reduced iHc and poor squareness, i.e., properties not viable as commercial products.

It is presumed that such substantial losses of magnetic properties occur because in the existing ultra-high performance magnets having the R-rich phase reduced to the necessary minimum level, even a slight increase in carbon concentration can cause a substantial part of the R-rich phase which has not been oxidized to become a carbide. Then the quantity of the R-rich phase necessary for liquid phase sintering is extremely reduced.

The neodymium-base sintered magnets commercially manufactured so far are known to start reducing the coercivity when the carbon concentration exceeds approximately 0.05% and become commercially unacceptable in excess of approximately 0.1%.

DISCLOSURE OF THE INVENTION

An object of the present invention is to provide a Nd—Fe—B base rare earth permanent magnet material which has controlled abnormal grain growth, a broader optimum sintering temperature range, and better magnetic properties, despite a high carbon concentration and a low oxygen concentration.

Regarding a R—Fe—B base rare earth permanent magnet material containing Co, Al and Cu and having a high carbon concentration, the inventor has found that when not only at least two compounds selected from among M-B, M-B—Cu, and M-C based compounds wherein M is one or more of Ti, Zr, and Hf, but also an R oxide have precipitated within the alloy structure, and the precipitated compounds have an average grain size of up to 5 μm and are uniformly distributed in the alloy structure at a maximum interval of up to 50 μm between adjacent precipitated compounds, then magnetic properties of the Nd base magnet alloy having a high carbon concentration are significantly improved. Specifically, a Nd—Fe—B base rare earth magnet having a coercivity kept undeteriorated even at a carbon concentration in excess of 0.05% by weight, especially 0.1% by weight is obtainable.

Accordingly, the present invention provides a rare earth permanent magnet material based on an R—Fe—Co—B—Al—Cu system wherein R is at least one element selected from the group consisting of Nd, Pr, Dy, Tb, and Ho, with 15 to 33% by weight of Nd being contained, wherein (i) at least two compounds selected from the group consisting of an M-B based compound, an M-B—Cu based compound, and an M-C based compound wherein M is at least one metal selected from the group consisting of Ti, Zr, and Hf, and (ii) an R oxide have precipitated within the alloy structure, and the precipitated compounds have an average grain size of up to 5 μm and are distributed in the alloy structure at a maximum interval of up to 50 μm between adjacent precipitated compounds.

In a preferred embodiment, an $R_2Fe_{14}B_1$ phase is present as a primary phase component in a volumetric proportion of 89 to 99%, and borides, carbides and oxides of rare earth or rare earth and transition metal are present in a total volumetric proportion of 0.1 to 3%.

In a further preferred embodiment, abnormally grown giant grains of $R_2Fe_{14}B_1$ phase having a grain size of at least 50 μm are present in a volumetric proportion of up to 3% based on the overall metal structure.

Typically, the permanent magnet material exhibits magnetic properties including a remanence Br of at least 12.5 kG, a coercive force iHc of at least 10 kOe, and a squareness ratio $4\times(BH)max/Br^2$ of at least 0.95. Note that (BH)max is the maximum energy product.

In a further preferred embodiment, the Nd—Fe—B base magnet alloy consists essentially of; in % by weight, 27 to 33% of R wherein R is at least one element selected from the group consisting of Nd, Pr, Dy, Tb, and Ho, including 15 to 33% by weight of Nd, 0.1 to 10% of Co, 0.8 to 1.5% of B, 0.05 to 1.0% of Al, 0.02 to 1.0% of Cu, 0.02 to 1.0% of an element selected from Ti, Zr, and Hf, more than 0.1 to 0.3% of C, 0.04 to 0.4% of O, 0.002 to 0.1% of N, and the balance of Fe and incidental impurities.

The Nd—Fe—B base rare earth permanent magnet material of the present invention in which not only at least two compounds selected from among M-B, M-B—Cu, and M-C based compounds but also an R oxide have precipitated in fine form has controlled abnormal grain growth, a broader optimum sintering temperature range, and better magnetic properties despite high carbon and low oxygen concentrations.

DETAILED DESCRIPTION OF THE INVENTION

The Nd—Fe—B base rare earth permanent magnet material of the present invention is a permanent magnet material based on an R—Fe—Co—B—Al—Cu system wherein R is at least one element selected from the group consisting of Nd, Pr, Dy, Tb, and Ho, with 15 to 33% by weight of Nd being contained. Preferably, carbon is present in an amount of more than 0.1% to 0.3% by weight, especially more than 0.1% to 0.2% by weight; a $Nd_2Fe_{14}B_1$ phase is present as a primary phase component in a volumetric proportion of 89 to 99%, and borides, carbides and oxides of rare earth or rare earth and transition metal are present in a total volumetric proportion of 0.1 to 3%. Provided that M is at least one metal selected from the group consisting of Ti, Zr, and Hf, in this permanent magnet material, (i) at least two compounds selected from the group consisting of an M-B based compound, M-B—Cu based compound, and M-C based compound, and (ii) an R oxide have precipitated within the alloy structure, and the precipitated compounds have an average grain size of up to 5 μm and are uniformly distributed in the alloy structure at a maximum interval of up to 50 μm between adjacent precipitated compounds.

Reference is made to magnetic properties of the Nd—Fe—B base magnet alloy. The remanence and the energy product of such magnet alloy have been improved by increasing the volumetric proportion of the $Nd_2Fe_{14}B_1$ phase that develops magnetism and decreasing in inverse proportion thereof the non-magnetic Nd-rich grain boundary phase. The Nd-rich phase serves to generate coercivity by cleaning the grain boundaries of the primary $Nd_2Fe_{14}B_1$ phase and removing grain boundary impurities and crystal defects. Hence, the Nd-rich phase cannot be entirely removed from the magnet alloy structure, regardless of how high this would make the flux density. Therefore, the key to further improvement of the magnetic properties is how to make the most effective use of a small amount of Nd-rich phase for cleaning the grain boundaries, and thus achieve a high coercivity.

In general, the Nd-rich phase is chemically active, and so it readily undergoes oxidation, carbonizing or nitriding in the course of processes such as milling and sintering, resulting in the consumption of Nd. Then, the grain boundary structure cannot be cleaned to a full extent, making it impossible in turn to attain the desired coercivity. Effective use of the minimal amount of Nd-rich phase so as to obtain high-performance magnets having a high remanence and a high coercivity is possible only if measures are taken for preventing oxidation, carbonizing or nitriding of the Nd-rich phase throughout the production process including the raw material stage.

In the sintering process, densification proceeds via a sintering reaction within the finely divided powder. As particles of the pressed and compacted fine powder mutually bond and diffuse at the sintering temperature, the pores throughout the powder are displaced to the exterior, so that the powder fills the space within the compact, causing it to shrink. The Nd-rich liquid phase present at this time is believed to promote a smooth sintering reaction.

However, understandably, if the sintered compact has an increased carbon concentration as a result of using inexpensive raw materials having a high carbon concentration, more neodymium carbide forms which prevents the grain boundaries from being cleaned or removed of impurities or crystal defects, leading to substantial losses of coercivity.

Then, in a Nd—Fe—B base magnet alloy having a high carbon concentration, the inventor has succeeded in substantially restraining formation of neodymium carbide and substituting C for B in the $R_2Fe_{14}B_1$ phase as primary phase grains, by causing at least two of M-B, M-B—Cu and M-C compounds to precipitate out.

In high-performance neodymium magnets which have a low neodymium content and for which oxidation during production has been suppressed, too little neodymium oxide is present to achieve a sufficient pinning effect. This allows certain crystal grains to rapidly grow in size at the sintering temperature, leading to the formation of giant, abnormally grown grains, which mainly results in a substantial loss of squareness.

We have resolved these problems by causing at least two of an M-B compound, M-B—Cu compound and M-C compound and an R oxide to precipitate out in neodymium magnet alloy, thereby restraining abnormal grain growth in the sintered alloy on account of their pinning effect along grain boundaries.

The M-B compound, M-B—Cu compound and M-C compound and the R oxide thus precipitated are effective for restraining the generation of abnormally grown giant grains over a broad sintering temperature range. It is thus possible to reduce the volumetric proportion of abnormally grown giant grains of $R_2Fe_{14}B_1$ phase having a grain size of at least 50 μm to 3% or less based on the overall metal structure.

Also the M-B compound, M-B—Cu compound and M-C compound thus precipitated are effective for minimizing a reduction of coercivity of an alloy having a high carbon concentration during sintering. This enables manufacture of high-performance magnets even with a high carbon concentration.

In the rare earth permanent magnet material of the present invention, preferably high performance Nd—Fe—B base magnet alloy in which a $Nd_2Fe_{14}B_1$ phase is present as a primary phase component in a volumetric proportion of 89 to 99%, more preferably 93 to 98%, and borides, carbides and oxides of rare earth or rare earth and transition metal are present in a total volumetric proportion of 0.1 to 3%, more preferably 0.5 to 2%, at least two compounds selected from the group consisting of an M-B compound, M-B—Cu compound, and M-C compound, and an R oxide have precipitated within the alloy structure, and the precipitated compounds have an average grain size of up to 5 μm, preferably 0.1 to 5 μm, more preferably 0.5 to 2 μm, and are uniformly distributed in the alloy structure at a maximum interval of up to 50 μm, preferably 5 to 10 μm, between adjacent precipitated compounds. It is preferred that the volumetric proportion of abnormally grown giant grains of $R_2Fe_{14}B_1$ phase having a grain size of at least 50 pin be 3% or less based on the overall metal structure. It is further preferred that the Nd-rich phase be 0.5 to 10%, especially 1 to 5% based on the overall metal structure.

Preferably the rare-earth permanent magnet alloy of the invention has a composition that consists essentially of, in % by weight, 27 to 33%, and especially 28.8 to 31.5%, of R; 0.1 to 10%, and especially 1.3 to 3.4%, of cobalt; 0.8 to 1.5%, more preferably 0.9 to 1.4%, and especially 0.95 to 1.15%, of boron; 0.05 to 1.0%, and especially 0.1 to 0.5%, of aluminum; 0.02 to 1.0%, and especially 0.05 to 0.3%, of copper; 0.02 to 1.0%, and especially 0.04 to 0.4%, of an element selected from among titanium, zirconium, and hafnium; more than 0.1 to 0.3%, and especially more than 0.1 to 0.2%, of carbon; 0.04 to 0.4%, and especially 0.06 to 0.3%, of oxygen; and 0.002 to 0.1%, and especially 0.005 to 0.1%, of nitrogen; with the balance being iron and incidental impurities.

As noted above, R stands for one or more rare-earth elements, one of which must be neodymium. The alloy must have a neodymium content of 15 to 33 wt %, and preferably 18 to 33 wt %. The alloy preferably has an R content of 27 to 33 wt % as defined just above. Less than 27 wt % of R may lead to an excessive decline in coercivity whereas more than 33 wt % of R may lead to an excessive decline in remanence.

In the practice of the invention, substituting some of the iron with cobalt is effective for improving the Curie temperature (Tc). Cobalt is also effective for reducing the weight loss of sintered magnet upon exposure to high temperature and high humidity. A cobalt content of less than 0.1 wt % offers little of the Tc and weight loss improving effects. From the standpoint of cost, a cobalt content of 0.1 to 10 wt % is desirable.

A boron content below 0.8 wt % may lead to a noticeable decrease in coercivity, whereas more than 1.5 wt % of boron may lead to a noticeable decline in remanence. Hence, a boron content of 0.8 to 1.5 wt % is preferred.

Aluminum is effective for raising the coercivity without incurring additional cost. Less than 0.05 wt % of Al contributes to little increase in coercivity, whereas more than 1.0 wt % of Al may result in a large decline in the remanence. Hence, an aluminum content of 0.05 to 1.0 wt % is preferred.

Less than 0.02 wt % of copper may contribute to little increase in coercivity, whereas more than 1.0 wt % of copper may result in an excessive decrease in remanence. A copper content of 0.02 to 1.0 wt % is preferred.

The element selected from among titanium, zirconium, and hafnium helps increase some magnetic properties, particularly coercivity, because it, when added in combination with copper and carbon, expands the optimum sintering temperature range and because it forms a compound with carbon, thus preventing the Nd-rich phase from carbonization. At less than 0.02 wt %, the coercivity increasing effect may become negligible, whereas more than 1.0 wt % may lead to an excessive decrease in remanence. Hence, a content of this element within a range of 0.02 to 1.0 wt % is preferred.

A carbon content equal to or less than 0.1 wt %, especially equal to or less than 0.05 wt % may fail to take full advantage of the present invention whereas at more than 0.3 wt % of C, the desired effect may not be exerted. Hence, the carbon content is preferably from more than 0.1 wt % to 0.3 wt %, more preferably from more than 0.1 wt % to 0.2 wt %.

A nitrogen content below 0.002 wt % may often invite over-sintering and lead to poor squareness, whereas more than 0.1 wt % of N may have negative impact on the sinterability and squareness and even lead to a decline of coercivity. Hence, a nitrogen content of 0.002 to 0.1 wt % is preferred.

An oxygen content of 0.04 to 0.4 wt % is preferred.

The raw materials for Nd, Pr, Dy, Tb, Cu, Ti, Zr, Hf and the like used herein may be alloys or mixtures with iron, aluminum or the like. The additional presence of a small amount of up to 0.2 wt % of lanthanum, cerium, samarium, nickel, manganese, silicon, calcium, magnesium, sulfur, phosphorus, tungsten, molybdenum, tantalum, chromium, gallium and niobium already present in the raw materials or admixed during the production processes does not compromise the effects of the invention.

The permanent magnet material of the invention can be produced by using preselected materials as indicated in the subsequent examples, preparing an alloy therefrom according to a conventional process, optionally subjecting the alloy to hydriding and dehydriding, followed by pulverization, compaction, sintering and heat treatment. Use can also be made of what is sometimes referred to as a "two alloy process."

In the preferred embodiment, raw materials having a relatively high carbon concentration are used and the amount of Ti, Zr or Hf added is selected so as to fall within the proper range of 0.02 to 1.0 wt %. Then the magnetic material of the invention can be produced by sintering in an inert gas atmosphere at 1,000 to 1,200° C. for 0.5 to 5 hours and heat treating in an inert gas atmosphere at 300 to 600° C. for 0.5 to 5 hours.

According to the invention, by subjecting an R—Fe—Co—B—Al—Cu base system which contains a high concentration of carbon and a very small amount of Ti, Zr or Hf and thus has a certain composition range of R—Fe—Co—B—Al—Cu—(Ti/Zr/Hf) to alloy casting, milling, compaction, sintering and also heat treatment at a temperature lower than the sintering temperature, a magnet alloy can be produced which has an increased remanence (Br) and coercivity (iHc), an excellent squareness ratio, and a broad optimum sintering temperature range.

The permanent magnet materials of the invention can thus be endowed with excellent magnetic properties, including a remanence (Br) of at least 12.5 G, a coercivity (iHc) of at least 10 kOe, and a squareness ratio ($4\times(BH)max/Br^2$) of at least 0.95.

EXAMPLE

Examples and comparative examples are given below to illustrate the invention, but are not intended to limit the scope thereof.

The starting materials having a relatively high carbon concentration used in Examples are those materials having a total carbon concentration of more than 0.1 wt % to 0.2 wt %, from which no satisfactory magnetic properties were expectable when processed in the prior art. If not specified, the starting materials have a total carbon concentration of 0.005 to 0.05 wt %.

Example 1

The starting materials: neodymium, praseodymium, electrolytic iron, cobalt, ferroboron, aluminum, copper and titanium were formulated to a composition, by weight, of 28.9Nd-2.5Pr-balance Fe-4.5Co-1.2B-0.7Al-0.4Cu-xTi (where x=0, 0.04, 0.4 or 1.4), following which the respective alloys were prepared by a single roll quenching process. The alloys were then hydrided in a +1.5±0.3 kgf/cm$^2$ hydrogen atmosphere, and dehydrided at 800° C. for a period of 3 hours in a vacuum of up to $10^{-2}$ Torr. Each of the alloys following hydriding and dehydriding was in the form of a coarse powder having a particle size of several hundred microns. The coarse powders were each mixed with 0.1 wt % of stearic acid as lubricant in a V-mixer, and pulverized to an average particle size of about 3 μm under a nitrogen stream in a jet mill. The resulting fine powders were filled into the die of a press, oriented in a 25 kOe magnetic field, and compacted under a pressure of 0.5 metric tons/cm$^2$ applied perpendicular to the magnetic field. The powder compacts thus obtained were sintered at temperatures differing by 10° C. in the range of 1000° C. to 1200° C. for 2 hours in an argon atmosphere, then cooled. After cooling, they were heat-treated at 500° C. for 1 hour in argon, yielding permanent magnet materials of the respective compositions. These R—Fe—B base permanent magnet materials had a carbon content of 0.111 to 0.133 wt %, an oxygen content of 0.095 to 0.116 wt %, and a nitrogen content of 0.079 to 0.097 wt %.

The magnetic properties of the resulting magnet materials are shown in Table 1. It is seen that the magnet materials having 0.04% and 0.4% of Ti added thereto kept satisfactory values of Br, iHc and squareness ratio substantially unchanged when sintered at temperatures from 1040° C. to 1070° C., indicating an optimum sintering temperature band of 30 degrees Centigrade.

The magnet material having 0% Ti added wherein the carbon concentration was 0.111-0.133 wt % as in this Example had a low iHc and poor squareness.

The magnet material having 1.4% of Ti added thereto kept fairly satisfactory values of Br, iHc and squareness ratio substantially unchanged when sintered at temperatures from 1040° C. to 1070° C., indicating an optimum sintering temperature band of 30 degrees Centigrade, but the values of Br and iHc were lower than the 0.04% and 0.4% Ti magnet materials because of the excess of Ti.

TABLE 1

| Ti content (wt %) | Optimum sintering temperature (° C.) | Br (kG) | iHc (kOe) | Squareness ratio |
|---|---|---|---|---|
| 0 | 1,040 | 13.61 | 1.1 | 0.256 |
| 0.04 | 1,040-1,070 | 13.79-13.91 | 12.7-13.5 | 0.968-0.972 |
| 0.4 | 1,040-1,070 | 13.75-13.88 | 12.4-12.9 | 0.965-0.971 |
| 1.4 | 1,040-1,070 | 13.56-13.69 | 11.3-11.9 | 0.963-0.969 |

Example 2

The starting materials: neodymium having a relatively high carbon concentration, dysprosium, electrolytic iron, cobalt, ferroboron, aluminum, copper and titanium were formulated to a composition, by weight, of 28.6Nd-2.5Dy-balance Fe-9.0Co-1.0B-0.8Al-0.6Cu-xTi (where x=0.01, 0.2, 0.6 or 1.5) so as to compare the effects of different amounts of titanium addition, following which ingots of the respective compositions were prepared by high-frequency melting and casting in a water-cooled copper mold. The ingots were crushed in a Brown mill. Each of the coarse powders thus obtained was mixed with 0.05 wt % of lauric acid as lubricant in a V-mixer, and pulverized to an average particle size of about 5 μm under a nitrogen stream in a jet mill. The resulting fine powders were filled into the die of a press, oriented in a 15 kOe magnetic field, and compacted under a pressure of 1.2 metric tons/cm$^2$ applied perpendicular to the magnetic field. The powder compacts thus obtained were sintered at temperatures in the range of 1000° C. to 1200° C. for 2 hours in a vacuum atmosphere of up to 10" Torr, then cooled. After cooling, they were heat-treated at 500° C. for 1 hour in a vacuum atmosphere of up to $10^{-2}$ Torr, yielding permanent magnet materials of the respective compositions. These R—Fe—B base permanent magnet materials had a carbon content of 0.180 to 0.208 wt %, an oxygen content of 0.328 to 0.398 wt %, and a nitrogen content of 0.027 to 0.041 wt %.

The magnetic properties of the resulting magnet materials are shown in Table 2. It is seen that the magnet materials having 0.2% and 0.6% of Ti added thereto kept satisfactory values of Br, iHc and squareness ratio substantially unchanged when sintered at temperatures from 1100° C. to 1130° C., indicating an optimum sintering temperature band of 30 degrees Centigrade.

The magnet material having 0.01% of Ti added wherein the carbon concentration was 0.180-0.208 wt % as in this Example had a low iHc and poor squareness.

The magnet material having 1.5% of Ti added thereto kept fairly satisfactory values of Br, iHc and squareness ratio substantially unchanged when sintered at temperatures from 1100° C. to 1130° C., indicating an optimum sintering temperature band of 30 degrees Centigrade, but the values of Br and iHc were lower than the 0.2% and 0.6% Ti magnet materials because of the excess of Ti.

TABLE 2

| Ti content (wt %) | Optimum sintering temperature (° C.) | Br (kG) | iHc (kOe) | Squareness ratio |
|---|---|---|---|---|
| 0.01 | 1,100 | 12.75 | 9.2 | 0.846 |
| 0.2 | 1,110-1,130 | 12.98-13.05 | 14.8-15.6 | 0.969-0.973 |
| 0.6 | 1,110-1,130 | 12.94-13.05 | 14.3-14.9 | 0.964-0.970 |
| 1.5 | 1,110-1,130 | 12.64-12.70 | 12.0-12.8 | 0.962-0.966 |

Example 3

The starting materials used were neodymium having a relatively high carbon concentration, terbium, electrolytic iron, cobalt, ferroboron, aluminum, copper and titanium. For the two alloy process, a mother alloy was formulated to a composition, by weight, of 27.3Nd-balance Fe-0.5Co-1.0B-0.4Al-0.2Cu and an auxiliary alloy formulated to a composition, by weight, of 46.2Nd-17.0Tb-balance Fe-18.9Co-xTi (where x=0.2, 4.0, 9.8 or 25). The final composition after mixing was 29.2Nd-1.7Tb-balance Fe-2.3Co-0.9B-0.4Al-0.2Cu-xTi (where x=0.01, 0.2, 0.5 or 1.3) in weight ratio. The mother alloy was prepared by a single roll quenching process, then hydrided in a hydrogen atmosphere of +0.5 to +2.0 kgf/cm$^2$, and semi-dehydrided at 500° C. for a period of 3 hours in a vacuum of up to $10^{-2}$ Torr. The auxiliary alloy was prepared as an ingot by high-frequency melting and casting in a water-cooled copper mold.

Next, 90 wt % of the mother alloy and 10 wt % of the auxiliary alloy were weighed and mixed in a V-mixer along with 0.05 wt % of PVA as lubricant. The mixes were pulverized to an average particle size of about 4 μm under a nitrogen stream in a jet mill. The resulting fine powders were filled into the die of a press, oriented in a 15 kOe magnetic field, and compacted under a pressure of 0.5 metric tons/cm$^2$ applied perpendicular to the magnetic field. The powder compacts thus obtained were sintered at temperatures differing by 10° C. in the range of 1000° C. to 1200° C. for 2 hours in a vacuum atmosphere of up to $10^{-4}$ Torr, then cooled. After cooling, they were heat-treated at 500° C. for 1 hour in an argon atmosphere of up to $10^{-2}$ Torr, yielding permanent magnet materials of the respective compositions. These R—Fe—B base permanent magnet materials had a carbon content of 0.248 to 0.268 wt %, an oxygen content of 0.225 to 0.298 wt %, and a nitrogen content of 0.029 to 0.040 wt %.

The magnetic properties of the resulting magnet materials are shown in Table 3. It is seen that the magnet materials having 0.2% and 0.5% of Ti added thereto kept satisfactory values of Br, iHc and squareness ratio substantially unchanged when sintered at temperatures from 1060° C. to 1090° C., indicating an optimum sintering temperature band of 30 degrees Centigrade.

The magnet material having 0.01% of Ti added wherein the carbon concentration was 0.248-0.268 wt % as in this Example had a low iHc and poor squareness.

The magnet material having 1.3% of Ti added thereto kept fairly satisfactory values of Br, iHc and squareness ratio substantially unchanged when sintered at temperatures from 1060° C. to 1090° C., indicating an optimum sintering temperature band of 30 degrees Centigrade, but the values of Br and iHc were lower than the 0.2% and 0.5% Ti magnet materials because of the excess of Ti.

TABLE 3

| Ti content (wt %) | Optimum sintering temperature (° C.) | Br (kG) | iHc (kOe) | Squareness ratio |
|---|---|---|---|---|
| 0.01 | 1,060 | 13.49 | 9.2 | 0.813 |
| 0.2 | 1,060-1,090 | 13.70-13.83 | 14.7-15.4 | 0.970-0.976 |
| 0.5 | 1,060-1,090 | 13.69-13.80 | 14.5-15.1 | 0.968-0.975 |
| 1.3 | 1,060-1,090 | 13.50-13.58 | 12.2-12.9 | 0.960-0.965 |

TABLE 4

| Ti content (wt %) | Optimum sintering temperature (° C.) | Br (kG) | iHc (kOe) | Squareness ratio |
|---|---|---|---|---|
| 0 | 1,070 | 12.98 | 0.5 | 0.095 |
| 0.1 | 1,070-1,100 | 13.89-14.01 | 11.9-12.5 | 0.971-0.975 |
| 0.7 | 1,070-1,100 | 13.78-13.92 | 12.0-12.6 | 0.969-0.975 |
| 1.7 | 1,070-1,100 | 13.46-13.53 | 10.1-10.5 | 0.961-0.967 |

Example 4

The starting materials used were neodymium having a relatively high carbon concentration, praseodymium, dysprosium, electrolytic iron, cobalt, ferroboron, aluminum, copper and titanium. For the two alloy process, as in the above Example, a mother alloy was formulated to a composition, by weight, of 26.8Nd-2.2Pr-balance Fe-0.5Co-1.0B-0.2Al and an auxiliary alloy formulated to a composition, by weight, of 37.4Nd-10.5Dy-balance Fe-26.0Co-0.8B-0.2Al-1.6Cu-xTi (where x=0, 1.2, 7.0 or 17.0). The final composition after mixing was 27.9Nd-2.0Pr-1.1Dy-balance Fe-3.0Co-1.08-0.2Al-0.2Cu-xTi (where x=0, 0.1, 0.7 or 1.7) in weight ratio. Both the mother and auxiliary alloys were prepared by a single roll quenching process. Only the mother alloy was then hydrided in a hydrogen atmosphere of +0.5 to +2.0 kgf/cm$^2$, and semi-dehydrided at 500° C. for a period of 3 hours in a vacuum of up to $10^{-2}$ Torr, yielding a coarse powder having an average particle size of several hundred microns. The auxiliary alloy was crushed in a Brown mill into a coarse powder having an average particle size of several hundred microns.

Next, 90 wt % of the mother alloy and 10 wt % of the auxiliary alloy were weighed and mixed in a V-mixer along with 0.1 wt % of caproic acid as lubricant. The mixes were pulverized to an average particle size of about 5 μm under a nitrogen stream in a jet mill. The resulting fine powders were filled into the die of a press, oriented in a 20 kOe magnetic field, and compacted under a pressure of 0.8 metric tons/cm$^2$ applied perpendicular to the magnetic field. The powder compacts thus obtained were sintered at temperatures differing by 10° C. in the range of 1000° C. to 1200° C. for 2 hours in a vacuum atmosphere of up to $10^{-4}$ Torr, then cooled. After cooling, they were heat-treated at 500° C. for 1 hour in an argon atmosphere of up to $10^{-2}$ Torr, yielding permanent magnet materials of the respective compositions. These R—Fe—B base permanent magnet materials had a carbon content of 0.198 to 0.222 wt %, an oxygen content of 0.095 to 0.138 wt %, and a nitrogen content of 0.069 to 0.090 wt %.

The magnetic properties of the resulting magnet materials are shown in Table 4. It is seen that the magnet materials having 0.1% and 0.7% of Ti added thereto kept satisfactory values of Br, iHc and squareness ratio substantially unchanged when sintered at temperatures from 1070° C. to 1100° C., indicating an optimum sintering temperature band of 30 degrees Centigrade.

The magnet material free of Ti wherein the carbon concentration was 0.198-0.222 wt % as in this Example had a low iHc and poor squareness.

The magnet material having 1.7% of Ti added thereto kept fairly satisfactory values of Br, iHc and squareness ratio substantially unchanged when sintered at temperatures from 1070° C. to 1100° C., indicating an optimum sintering temperature band of 30 degrees Centigrade, but the values of Br and iHc were lower than the 0.1% and 0.7% Ti magnet materials because of the excess of Ti.

The samples of Examples 1 to 4 were observed by electron probe microanalysis (EPMA). The element distribution images revealed that in the sintered samples having a titanium content within the preferred range of 0.02 to 1.0 wt % according to the present invention, TiB compound, TiBCu compound and TiC compound had precipitated out uniformly as discrete fine grains with a diameter of up to 5 μm spaced apart at intervals of up to 50 μm.

These results demonstrate that the addition of an appropriate amount of Ti and the uniform precipitation of fine TiB, TiBCu and TiC compounds in the sintered body ensure that abnormal grain growth is restrained, the optimum sintering temperature range is expanded, and satisfactory magnetic properties are obtained even at such high carbon and low oxygen concentrations.

Example 5

The starting materials: neodymium having a relatively high carbon concentration, praseodymium, dysprosium, terbium, electrolytic iron, cobalt, ferroboron, aluminum, copper and zirconium were formulated to a composition, by weight, of 26.7Nd-1.1Pr-1.3Dy-1.2Tb-balance Fe-3.6Co-1.1B-0.4Al-0.1Cu-xZr (where x=0, 0.1, 0.6 or 1.3) so as to compare the effects of different amounts of zirconium addition, following which the respective alloys were prepared by a twin roll quenching process. The alloys were then hydrided in a +1.0±0.2 kgf/cm$^2$ hydrogen atmosphere, and dehydrided at 700° C. for a period of 5 hours in a vacuum of up to $10^{-2}$ Torr. Each of the alloys following hydriding and dehydriding was in the form of a coarse powder having a particle size of several hundred microns. The coarse powders were each mixed with 0.1 wt % of Panacet® (NOF Corp.) as lubricant in a V-mixer, and pulverized to an average particle size of about 5 μm under a nitrogen stream in a jet mill. The resulting fine powders were filled into the die of a press, oriented in a 20 kOe magnetic field, and compacted under a pressure of 1.2 metric tons/cm$^2$ applied perpendicular to the magnetic field. The powder compacts thus obtained were sintered at temperatures in the range of 1000° C. to 1200° C. for 2 hours in an argon atmosphere, then cooled. After cooling, they were heat-treated at 500° C. for 1 hour in argon, yielding permanent magnet materials of the respective compositions. These R—Fe—B base permanent magnet materials had a carbon content of 0.141 to 0.153 wt %, an oxygen content of 0.093 to 0.108 wt %, and a nitrogen content of 0.059 to 0.074 wt %.

The magnetic properties of the resulting magnet materials are shown in Table 5. It is seen that the magnet materials having 0.1% and 0.6% of Zr added thereto kept satisfactory values of Br, iHc and squareness ratio substantially unchanged when sintered at temperatures from 1050° C. to 1080° C., indicating an optimum sintering temperature band of 30 degrees Centigrade.

The magnet material free of Zr wherein the carbon concentration was 0.141-0.153 wt % as in this Example had a very low iHc.

The magnet material having 1.3% of Zr added thereto kept fairly satisfactory values of Br, iHc and squareness ratio substantially unchanged when sintered at temperatures from 1050° C. to 1080° C., indicating an optimum sintering temperature band of 30 degrees Centigrade, but the values of Br and iHc were lower because of the excess of Zr.

TABLE 5

| Zr content (wt %) | Optimum sintering temperature (° C.) | Br (kG) | iHc (kOe) | Squareness ratio |
|---|---|---|---|---|
| 0 | 1,050 | 12.88 | 2.5 | 0.355 |
| 0.1 | 1,050-1,080 | 13.65-13.73 | 14.3-14.9 | 0.962-0.965 |
| 0.6 | 1,050-1,080 | 13.62-13.69 | 14.5-15.0 | 0.963-0.966 |
| 1.3 | 1,050-1,080 | 13.42-13.51 | 12.7-13.5 | 0.960-0.962 |

Example 6

The starting materials: neodymium having a relatively high carbon concentration, dysprosium, electrolytic iron, cobalt, ferroboron, aluminum, copper and ferrozirconium were formulated to a composition, by weight, of 28.7Nd-2.5Dy-balance Fe-1.8Co-1.0B-0.8Al-0.2Cu-xZr (where x=0.01, 0.07, 0.7 or 1.4) so as to compare the effects of different amounts of zirconium addition. Ingots of the respective compositions were prepared by high-frequency melting and casting in a water-cooled copper mold. The ingots were crushed in a Brown mill. The coarse powders were each mixed with 0.07 wt % of Olfine® (Nisshin Chemical Co., Ltd.) as lubricant in a V-mixer, and pulverized to an average particle size of about 5 μm under a nitrogen stream in a jet mill. The resulting fine powders were filled into the die of a press, oriented in a 20 kOe magnetic field, and compacted under a pressure of 0.7 metric tons/$cm^2$ applied perpendicular to the magnetic field. The powder compacts thus obtained were sintered at temperatures in the range of 1000° C. to 1200° C. for 2 hours in an argon atmosphere, then cooled. After cooling, they were heat-treated at 500° C. for 1 hour in argon, yielding permanent magnet materials of the respective compositions. These R—Fe—B base permanent magnet materials had a carbon content of 0.141 to 0.162 wt %, an oxygen content of 0.248 to 0.271 wt %, and a nitrogen content of 0.003 to 0.010 wt %.

The magnetic properties of the resulting magnet materials are shown in Table 6. It is seen that the magnet materials having 0.07% and 0.7% of Zr added thereto kept satisfactory values of Br, iHc and squareness ratio substantially unchanged when sintered at temperatures from 1110° C. to 1140° C., indicating an optimum sintering temperature band of 30 degrees Centigrade.

The magnet material having 0.01% of Zr wherein the carbon concentration was high and the oxygen concentration was low as in this Example had a very low iHc.

The magnet material having 1.4% of Zr added thereto kept fairly satisfactory values of Br, iHc and squareness ratio substantially unchanged when sintered at temperatures from 1110° C. to 1140° C., indicating an optimum sintering temperature band of 30 degrees Centigrade, but the values of Br and iHc were lower because of the excess of Zr.

TABLE 6

| Zr content (wt %) | Optimum sintering temperature (° C.) | Br (kG) | iHc (kOe) | Squareness ratio |
|---|---|---|---|---|
| 0.01 | 1,110 | 12.88 | 2.5 | 0.012 |
| 0.07 | 1,110-1,140 | 13.33-13.45 | 16.5-17.0 | 0.963-0.967 |
| 0.7 | 1,110-1,140 | 13.29-13.40 | 16.3-16.8 | 0.961-0.966 |
| 1.4 | 1,110-1,140 | 13.00-13.09 | 14.0-14.5 | 0.960-0.962 |

Example 7

This example attempted to acquire better magnetic properties by utilizing the two alloy process. The starting materials used were neodymium having a relatively high carbon concentration, dysprosium, electrolytic iron, cobalt, ferroboron, aluminum, copper and zirconium. A mother alloy was formulated to a composition, by weight, of 28.3Nd-balance Fe-0.9Co-1.2B-0.2Al-xZr (where x=0, 0.07, 0.7 or 1.4) and an auxiliary alloy formulated to a composition, by weight, of 34.0Nd-19.2Dy-balance Fe-24.3Co-0.2B-1.5Cu. The final composition after mixing was 28.9Nd-1.9Dy-balance Fe-3.3Co-1.1B-0.2Al-0.2Cu-xZr (where x=0, 0.06, 0.6 or 1.3) in weight ratio. The mother alloy was prepared by a single roll quenching process, then hydrided in a hydrogen atmosphere of +0.5 to +2.0 kgf/$cm^2$, and semi-dehydrided at 500° C. for a period of 3 hours in a vacuum of up to $10^{-2}$ Torr. The auxiliary alloy was prepared as an ingot by high-frequency melting and casting in a water-cooled copper mold.

Next, 90 wt % of the mother alloy and 10 wt % of the auxiliary alloy were weighed and mixed in a V-mixer along with 0.05 wt % of stearic acid as lubricant. The mixes were pulverized to an average particle size of about 4 μm under a nitrogen stream in a jet mill. The resulting fine powders were filled into the die of a press, oriented in a 15 kOe magnetic field, and compacted under a pressure of 0.5 metric tons/$cm^2$ applied perpendicular to the magnetic field. The powder compacts thus obtained were sintered at temperatures differing by 10° C. in the range of 1000° C. to 1200° C. for 2 hours in a vacuum atmosphere of up to $10^{-4}$ Torr, then cooled. After cooling, they were heat-treated at 500° C. for 1 hour in an argon atmosphere of up to $10^{-2}$ Torr, yielding permanent magnet materials of the respective compositions. These R—Fe—B base permanent magnet materials had a carbon content of 0.203 to 0.217 wt %, an oxygen content of 0.125 to 0.158 wt %, and a nitrogen content of 0.021 to 0.038 wt %.

The magnetic properties of the resulting magnet materials are shown in Table 7. It is seen that the magnet materials having 0.06% and 0.6% of Zr added thereto kept satisfactory values of Br, iHc and squareness ratio substantially unchanged when sintered at temperatures from 1060° C. to 1090° C., indicating an optimum sintering temperature band of 30 degrees Centigrade.

The magnet material free of Zr wherein the carbon concentration was 0.203-0.217 wt % as in this Example had a very low iHc.

The magnet material having 1.3% of Zr added thereto kept fairly satisfactory values of Br, iHc and squareness ratio substantially unchanged when sintered at temperatures from 1060° C. to 1090° C., indicating an optimum sintering temperature band of 30 degrees Centigrade, but the values of Br and iHc were lower than the 0.06% and 0.6% Zr magnet materials because of the excess of Zr.

TABLE 7

| Zr content after mixing (wt %) | Optimum sintering temperature (° C.) | Br (kG) | iHc (kOe) | Squareness ratio |
|---|---|---|---|---|
| 0 | 1,060 | 12.99 | 0.9 | 0.095 |
| 0.06 | 1,060-1,090 | 13.75-13.83 | 12.0-12.8 | 0.972-0.979 |
| 0.6 | 1,060-1,090 | 13.74-13.84 | 11.8-12.5 | 0.971-0.976 |
| 1.3 | 1,060-1,090 | 13.54-13.62 | 10.5-11.2 | 0.963-0.969 |

TABLE 8

| Zr content after mixing (wt %) | Optimum sintering temperature (° C.) | Br (kG) | iHc (kOe) | Squareness ratio |
|---|---|---|---|---|
| 0.01 | 1,070 | 13.00 | 16.5 | 0.965 |
| 0.1 | 1,070-1,100 | 12.99-13.12 | 16.2-16.8 | 0.970-0.979 |
| 0.5 | 1,070-1,100 | 12.96-13.05 | 16.0-16.5 | 0.971-0.976 |
| 1.1 | 1,070-1,100 | 12.88-12.98 | 14.0-14.4 | 0.969-0.973 |

Example 8

The starting materials used were neodymium, dysprosium, electrolytic iron, cobalt, ferroboron, aluminum, copper and zirconium. For the two alloy process, as in the above example, a mother alloy was formulated to a composition, by weight, of 27.0Nd-1.3Dy-balance Fe-1.8Co-1.0B-0.2Al-0.1Cu and an auxiliary alloy formulated to a composition, by weight, of 25.1Nd-28.3Dy-balance Fe-23.9Co-xZr (where x=0.1, 1.0, 5.0 or 11.0). The final composition after mixing was 26.8Nd-4.0Dy-balance Fe-4.0Co-0.9B-0.2Al-0.1Cu-xZr (where x=0.01, 0.1, 0.5 or 1.1) in weight ratio. Both the mother and auxiliary alloys were prepared by a single roll quenching process, then hydrided in a hydrogen atmosphere of +0.5 to +1.0 kgf/cm$^2$, and semi-dehydrided at 500° C. for a period of 4 hours in a vacuum of up to $10^{-2}$ Torr, yielding coarse powders having an average particle size of several hundred microns.

Next, 90 wt % of the mother alloy and 10 wt % of the auxiliary alloy were weighed and mixed in a V-mixer along with 0.15 wt % of lauric acid as lubricant. The mixes were pulverized to an average particle size of about 5 μm under a nitrogen stream in a jet mill. The resulting fine powders were filled into the die of a press, oriented in a 16 kOe magnetic field, and compacted under a pressure of 0.6 metric tons/cm$^2$ applied perpendicular to the magnetic field. The powder compacts thus obtained were sintered at temperatures differing by 10° C. in the range of 1000° C. to 1200° C. for 2 hours in a vacuum atmosphere of up to 10" Torr, then cooled. After cooling, they were heat-treated at 500° C. for 1 hour in an argon atmosphere, yielding permanent magnet materials of the respective compositions. These R—Fe—B base permanent magnet materials had a carbon content of 0.101 to 0.132 wt %, an oxygen content of 0.065 to 0.110 wt %, and a nitrogen content of 0.015 to 0.028 wt %.

The magnetic properties of the resulting magnet materials are shown in Table 8. It is seen that the magnet materials having 0.1% and 0.5% of Zr added thereto kept satisfactory values of Br, iHc and squareness ratio substantially unchanged when sintered at temperatures from 1070° C. to 1100° C., indicating an optimum sintering temperature band of 30 degrees Centigrade.

The magnet material having 0.01% of Zr added exhibited satisfactory values of Br, iHc and squareness ratio when sintered at 1070° C., but the optimum sintering temperature band was narrow as compared with the 0.1% and 0.5% Zr additions.

The magnet material having 1.1% of Zr added thereto kept fairly satisfactory values of Br, iHc and squareness ratio substantially unchanged when sintered at temperatures from 1070° C. to 1100° C., indicating an optimum sintering temperature band of 30 degrees Centigrade, but the values of Br and iHc were lower than the 0.1% and 0.5% Zr magnet materials because of the excess of Zr.

The samples of Examples 5 to 8 were observed by electron probe microanalysis (EPMA). The element distribution images revealed that in the sintered samples having a zirconium content within the preferred range of 0.02 to 1.0 wt % according to the present invention, ZrB compound, ZrBCu compound and ZrC compound had precipitated out uniformly as discrete fine grains with a diameter of up to 5 μm spaced apart at intervals of up to 50 μm.

These results demonstrate that the addition of an appropriate amount of Zr and the uniform precipitation of fine ZrB, ZrBCu and ZrC compounds in the sintered body ensure that abnormal grain growth is restrained, the optimum sintering temperature range is expanded, and satisfactory magnetic properties are obtained even at such high carbon and low oxygen concentrations.

Example 9

The starting materials: neodymium, praseodymium, dysprosium, electrolytic iron, cobalt, ferroboron, aluminum, copper and hafnium were formulated to a composition, by weight, of 26.7Nd-2.2Pr-2.5Dy-balance Fe-2.7Co-1.2B-0.4Al-0.3Cu-xHf (where x=0, 0.2, 0.5 or 1.4), following which the respective alloys were prepared by a single roll quenching process. The alloys were then hydrided in a +1.0±0.3 kgf/cm$^2$ hydrogen atmosphere, and dehydrided at 400° C. for a period of 5 hours in a vacuum of up to $10^{-2}$ Torr. Each of the alloys following hydriding and dehydriding was in the form of a coarse powder having a particle size of several hundred microns. The coarse powders were each mixed with 0.1 wt % of caproic acid as lubricant in a V-mixer, and pulverized to an average particle size of about 6 μm under a nitrogen stream in a jet mill. The resulting fine powders were filled into the die of a press, oriented in a 20 kOe magnetic field, and compacted under a pressure of 1.5 metric tons/cm$^2$ applied perpendicular to the magnetic field. The powder compacts thus obtained were sintered at temperatures in the range of 1000° C. to 1200° C. for 2 hours in an argon atmosphere, then cooled. After cooling, they were heat-treated at 500° C. for 1 hour in argon, yielding permanent magnet materials of the respective compositions. These R—Fe—B base permanent magnet materials had a carbon content of 0.111 to 0.123 wt %, an oxygen content of 0.195 to 0.251 wt %, and a nitrogen content of 0.009 to 0.017 wt %.

The magnetic properties of the resulting magnet materials are shown in Table 9. It is seen that the magnet materials having 0.2% and 0.5% of Hf added thereto kept satisfactory values of Br, iHc and squareness ratio substantially unchanged when sintered at temperatures from 1020° C. to 1050° C., indicating an optimum sintering temperature band of 30 degrees Centigrade.

The magnet material having 0% Hf wherein the carbon concentration was 0.111-0.123 wt % as in this Example had a low iHc and poor squareness.

The magnet material having 1.4% of Hf added thereto kept fairly satisfactory values of Br, iHc and squareness ratio substantially unchanged when sintered at temperatures from 1020° C. to 1050° C., indicating an optimum sintering temperature band of 30 degrees Centigrade, but the values of Br and iHc were lower than the 0.2% and 0.5% Hf magnet materials because of the excess of Hf.

TABLE 9

| Hf content (wt %) | Optimum sintering temperature (° C.) | Br (kG) | iHc (kOe) | Squareness ratio |
|---|---|---|---|---|
| 0 | 1,020 | 12.56 | 0.8 | 0.023 |
| 0.2 | 1,020-1,050 | 13.42-13.56 | 12.9-13.6 | 0.965-0.970 |
| 0.5 | 1,020-1,050 | 13.40-13.52 | 12.6-13.3 | 0.966-0.972 |
| 1.4 | 1,020-1,050 | 13.36-13.49 | 11.3-11.6 | 0.966-0.969 |

Example 10

The starting materials: neodymium having a relatively high carbon concentration, electrolytic iron, cobalt, ferroboron, aluminum, copper and hafnium were formulated to a composition, by weight, of 31.1Nd-balance Fe-3.6Co-1.1B-0.6Al-0.3Cu-xHf (where x=0.01, 0.4, 0.8 or 1.5) so as to compare the effects of different amounts of hafnium addition. Ingots of the respective compositions were prepared by high-frequency melting and casting in a water-cooled copper mold. The ingots were crushed in a Brown mill. The coarse powders were each mixed with 0.05 wt % of oleic acid as lubricant in a V-mixer, and pulverized to an average particle size of about 5 μm under a nitrogen stream in a jet mill. The resulting fine powders were filled into the die of a press, oriented in a 12 kOe magnetic field, and compacted under a pressure of 0.3 metric tons/cm$^2$ applied perpendicular to the magnetic field. The powder compacts thus obtained were sintered at temperatures in the range of 1000° C. to 1200° C. for 2 hours in a vacuum atmosphere of up to $10^{-4}$ Torr, then cooled. After cooling, they were heat-treated at 500° C. for 1 hour in a vacuum atmosphere of up to $10^{-2}$ Torr, yielding permanent magnet materials of the respective compositions. These R—Fe—B base permanent magnet materials had a carbon content of 0.180 to 0.188 wt %, an oxygen content of 0.068 to 0.088 wt %, and a nitrogen content of 0.062 to 0.076 wt %.

The magnetic properties of the resulting magnet materials are shown in Table 10. It is seen that the magnet materials having 0.4% and 0.8% of Hf added thereto kept satisfactory values of Br, iHc and squareness ratio substantially unchanged when sintered at temperatures from 1050° C. to 1080° C., indicating an optimum sintering temperature band of 30 degrees Centigrade.

The magnet material having 0.01% of Hf added exhibited satisfactory values of Br, iHc and squareness ratio when sintered at 1050° C., but the optimum sintering temperature band was narrow as compared with the 0.4% and 0.8% Hf additions.

The magnet material having 1.5% of Hf added thereto kept fairly satisfactory values of Br, iHc and squareness ratio substantially unchanged when sintered at temperatures from 1050° C. to 1080° C., indicating an optimum sintering temperature band of 30 degrees Centigrade, but the values of Br and iHc were lower than the 0.4% and 0.8% Hf magnet materials because of the excess of Hf.

TABLE 10

| Hf content (wt %) | Optimum sintering temperature (° C.) | Br (kG) | iHc (kOe) | Squareness ratio |
|---|---|---|---|---|
| 0.01 | 1,050 | 14.33 | 11.5 | 0.967 |
| 0.4 | 1,050-1,080 | 14.35-14.46 | 11.2-11.8 | 0.965-0.969 |
| 0.8 | 1,050-1,080 | 14.29-14.39 | 11.0-11.6 | 0.964-0.968 |
| 1.5 | 1,050-1,080 | 14.10-14.19 | 10.0-10.8 | 0.960-0.966 |

Example 11

This example attempted to acquire better magnetic properties by utilizing the two alloy process. The starting materials used were neodymium having a relatively high carbon concentration, dysprosium, electrolytic iron, cobalt, ferroboron, aluminum, copper and hafnium. A mother alloy was formulated to a composition, by weight, of 27.4Nd-balance Fe-0.3Co-1.1B-0.4Al-0.2Cu and an auxiliary alloy formulated to a composition, by weight, of 33.8Nd-19.0Dy-balance Fe-24.1Co-xHf (where x=0.1, 2.1, 7.9 or 15). The final composition after mixing was 28.0Nd-1.9Dy-balance Fe-2.7Co-1.0B-0.4Al-0.2Cu-xHf (where x=0.01, 0.2, 0.8 or 1.5) in weight ratio. The mother alloy was prepared by a single roll quenching process, then hydrided in a hydrogen atmosphere of +0.5 to +2.0 kgf/cm$^2$, and semi-dehydrided at 600° C. for a period of 3 hours in a vacuum of up to $10^{-2}$ Torr. The auxiliary alloy was prepared as an ingot by high-frequency melting and casting in a water-cooled copper mold.

Next, 90 wt % of the mother alloy and 10 wt % of the auxiliary alloy were weighed and mixed in a V-mixer along with 0.05 wt % of butyl laurate as lubricant. The mixes were pulverized to an average particle size of about 5 μm under a nitrogen stream in a jet mill. The resulting fine powders were filled into the die of a press, oriented in a 15 kOe magnetic field, and compacted under a pressure of 0.3 metric tons/cm$^2$ applied perpendicular to the magnetic field. The powder compacts thus obtained were sintered at temperatures differing by 10° C. in the range of 1000° C. to 1200° C. for 2 hours in a vacuum atmosphere of up to $10^{-4}$ Torr, then cooled. After cooling, they were heat-treated at 500° C. for 1 hour in an argon atmosphere of up to $10^{-2}$ Torr, yielding permanent magnet materials of the respective compositions. These R—Fe—B base permanent magnet materials had a carbon content of 0.283 to 0.297 wt %, an oxygen content of 0.095 to 0.108 wt %, and a nitrogen content of 0.025 to 0.044 wt %.

The magnetic properties of the resulting magnet materials are shown in Table 11. It is seen that the magnet materials having 0.2% and 0.8% of Hf added thereto kept satisfactory values of Br, iHc and squareness ratio substantially unchanged when sintered at temperatures from 1120° C. to 1150° C., indicating an optimum sintering temperature band of 30 degrees Centigrade.

The magnet material having 0.01% of Hf added exhibited satisfactory values of Br, iHc and squareness ratio when sintered at 1120° C., but the optimum sintering temperature band was narrow as compared with the 0.2% and 0.8% Hf additions.

The magnet material having 1.5% of Hf added thereto kept fairly satisfactory values of Br, iHc and squareness ratio substantially unchanged when sintered at temperatures from 1120° C. to 1150° C., indicating an optimum sintering temperature band of 30 degrees Centigrade, but the values of Br and iHc were lower than the 0.2% and 0.8% Hf magnet materials because of the excess of Hf.

TABLE 11

| Hf content after mixing (wt %) | Optimum sintering temperature (° C.) | Br (kG) | iHc (kOe) | Squareness ratio |
|---|---|---|---|---|
| 0.01 | 1,120 | 13.91 | 12.1 | 0.962 |
| 0.2 | 1,120-1,150 | 13.90-14.03 | 12.0-12.7 | 0.973-0.979 |
| 0.8 | 1,120-1,150 | 13.89-14.01 | 11.9-12.5 | 0.971-0.977 |
| 1.5 | 1,120-1,150 | 13.78-13.85 | 10.6-11.2 | 0.963-0.970 |

TABLE 12

| Hf content after mixing (wt %) | Optimum sintering temperature (° C.) | Br (kG) | iHc (kOe) | Squareness ratio |
|---|---|---|---|---|
| 0 | 1,160 | 12.52 | 0.3 | 0.045 |
| 0.05 | 1,160-1,190 | 12.88-12.98 | 20.1-21.0 | 0.970-0.976 |
| 0.5 | 1,160-1,190 | 12.82-12.90 | 19.9-20.8 | 0.971-0.977 |
| 1.5 | 1,160-1,190 | 12.71-12.79 | 18.5-19.1 | 0.966-0.973 |

Example 12

The starting materials used were neodymium, dysprosium, terbium, electrolytic iron, cobalt, ferroboron, aluminum, copper and hafnium. For the two alloy process, as in the above example, a mother alloy was formulated to a composition, by weight, of 26.0Nd-2.5Dy-balance Fe-1.4Co-1.08-0.8Al-0.2Cu-xHf (where x=0, 0.06, 0.6 or 1.7) and an auxiliary alloy formulated to a composition, by weight, of 40.8Nd-18.0Tb-balance Fe-20.0Co-0.1B-0.3Al. The final composition after mixing was 27.5Nd-2.3Dy-1.8Tb-balance Fe-3.2Co-0.9B-0.8Al-0.2Cu-xHf (where x=0, 0.05, 0.5 or 1.5) in weight ratio. Both the mother and auxiliary alloys were prepared by a single roll quenching process, then hydrided in a hydrogen atmosphere of +0.5 to +1.0 kgf/cm$^2$, and semi-dehydrided at 500° C. for a period of 2 hours in a vacuum of up to $10^{-2}$ Torr, yielding coarse powders having an average particle size of several hundred microns.

Next, 90 wt % of the mother alloy and 10 wt % of the auxiliary alloy were weighed and mixed in a V-mixer along with 0.1 wt % of caprylic acid as lubricant. The mixes were pulverized to an average particle size of about 5 μm under a nitrogen stream in a jet mill. The resulting fine powders were filled into the die of a press, oriented in a 25 kOe magnetic field, and compacted under a pressure of 0.5 metric tons/cm$^2$ applied perpendicular to the magnetic field. The powder compacts thus obtained were sintered at temperatures differing by 10° C. in the range of 1000° C. to 1200° C. for 2 hours in a vacuum atmosphere of up to $10^{-4}$ Torr, then cooled.

After cooling, they were heat-treated at 500° C. for 1 hour in an argon atmosphere, yielding permanent magnet materials of the respective compositions. These R—Fe—B base permanent magnet materials had a carbon content of 0.102 to 0.128 wt %, an oxygen content of 0.105 to 0.148 wt %, and a nitrogen content of 0.025 to 0.032 wt %.

The magnetic properties of the resulting magnet materials are shown in Table 12. It is seen that the magnet materials having 0.05% and 0.5% of Hf added thereto kept satisfactory values of Br, iHc and squareness ratio substantially unchanged when sintered at temperatures from 1160° C. to 1190° C., indicating an optimum sintering temperature band of 30 degrees Centigrade.

The magnet material having 0% Hf added exhibited satisfactory values of Br, iHc and squareness ratio when sintered at 1160° C., but the optimum sintering temperature band was narrow as compared with the 0.05% and 0.5% Hf additions.

The magnet material having 1.5% of Hf added thereto kept fairly satisfactory values of Br, iHc and squareness ratio substantially unchanged when sintered at temperatures from 1160° C. to 1190° C., indicating an optimum sintering temperature band of 30 degrees Centigrade, but the values of Br and iHc were lower than the 0.05% and 0.5% Hf magnet materials because of the excess of Hf.

The samples of Examples 9 to 12 were observed by electron probe microanalysis (EPMA). The element distribution images revealed that in the sintered samples having a hafnium content within the preferred range of 0.02 to 1.0 wt % according to the present invention, HfB compound, HfBCu compound and HfC compound had precipitated out uniformly as discrete fine grains with a diameter of up to 5 μm spaced apart at intervals of up to 50 μm.

These results demonstrate that the addition of an appropriate amount of Hf and the uniform precipitation of fine HfB, HfBCu and HfC compounds in the sintered body ensure that abnormal grain growth is restrained, the optimum sintering temperature range is expanded, and satisfactory magnetic properties are obtained even at such high carbon and low oxygen concentrations.

For the rare-earth permanent magnet materials prepared in Examples and Comparative Examples (with 0 wt % of Ti, Zr or Hf), the volumetric proportion of the $R_2Fe_{14}B_1$ phase, the total volumetric proportion of the borides, carbides and oxides of rare earth or rare earth and transition metal, and the volumetric proportion of abnormally grown giant grains of $R_2Fe_{14}B_1$ phase having a grain size of at least 50 μm are shown collectively in Table 13.

TABLE 13

| | Ti, Zr or Hf (wt %) | $R_2Fe_{14}B_1$ (vol %) | Boride + carbide + oxide (vol %) | Abnormal grains (vol %) |
|---|---|---|---|---|
| Example 1 | 0 | 88.8 | 4.1 | 4.5 |
| (Ti) | 0.04 | 90.1 | 2.2 | 1.5 |
| | 0.4 | 90.2 | 2.3 | 1.3 |
| | 1.4 | 90.0 | 2.1 | 1.4 |
| Example 2 | 0.01 | 90.9 | 3.9 | 4.8 |
| (Ti) | 0.2 | 93.1 | 2.6 | 0.7 |
| | 0.6 | 93.0 | 2.7 | 0.9 |
| | 1.5 | 93.2 | 2.5 | 0.8 |
| Example 3 | 0.01 | 89.9 | 4.5 | 5.1 |
| (Ti) | 0.2 | 94.3 | 2.2 | 0.5 |
| | 0.5 | 94.2 | 2.3 | 0.4 |
| | 1.3 | 94.0 | 2.1 | 0.3 |
| Example 4 | 0 | 89.2 | 3.2 | 6.8 |
| (Ti) | 0.1 | 92.5 | 0.5 | 0.6 |
| | 0.7 | 92.4 | 0.4 | 0.5 |
| | 1.7 | 92.3 | 0.3 | 0.4 |
| Example 5 | 0 | 92.0 | 3.5 | 4.2 |
| (Zr) | 0.1 | 96.2 | 2.0 | 1.2 |
| | 0.6 | 96.0 | 1.8 | 1.1 |
| | 1.3 | 95.8 | 1.7 | 1.0 |
| Example 6 | 0.01 | 88.9 | 3.8 | 4.5 |
| (Zr) | 0.07 | 94.0 | 1.2 | 0.9 |
| | 0.7 | 93.8 | 1.3 | 1.0 |
| | 1.4 | 93.7 | 1.4 | 0.8 |
| Example 7 | 0 | 92.9 | 2.9 | 2.9 |
| (Zr) | 0.06 | 95.0 | 1.0 | 0.9 |
| | 0.6 | 95.0 | 1.1 | 0.8 |
| | 1.3 | 94.6 | 1.2 | 0.7 |
| Example 8 | 0.01 | 94.1 | 2.8 | 2.8 |
| (Zr) | 0.1 | 94.7 | 0.7 | 0.9 |
| | 0.5 | 94.6 | 0.8 | 1.0 |
| | 1.1 | 94.0 | 0.7 | 0.8 |

TABLE 13-continued

| | Ti, Zr or Hf (wt %) | $R_2Fe_{14}B_1$ (vol %) | Boride + carbide + oxide (vol %) | Abnormal grains (vol %) |
|---|---|---|---|---|
| Example 9 | 0 | 84.0 | 6.2 | 7.8 |
| (Hf) | 0.2 | 93.6 | 2.2 | 1.8 |
| | 0.5 | 93.4 | 2.1 | 1.7 |
| | 1.4 | 93.5 | 2.0 | 1.9 |
| Example 10 | 0.01 | 94.8 | 2.5 | 1.9 |
| (Hf) | 0.4 | 95.3 | 1.6 | 0.5 |
| | 0.8 | 95.0 | 1.5 | 0.4 |
| | 1.5 | 94.6 | 1.4 | 0.3 |
| Example 11 | 0.01 | 95.5 | 2.8 | 1.3 |
| (Hf) | 0.2 | 98.4 | 2.4 | 0.8 |
| | 0.8 | 98.4 | 2.5 | 0.7 |
| | 1.5 | 98.1 | 2.3 | 0.9 |
| Example 12 | 0 | 88.2 | 3.5 | 6.8 |
| (Hf) | 0.05 | 95.3 | 2.4 | 0.2 |
| | 0.5 | 95.2 | 2.3 | 0 |
| | 1.5 | 95.1 | 2.2 | 0.1 |

Japanese Patent Application No. 2004-375784 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A rare earth permanent magnet material consists essentially of, in % by weight:

27 to 33% of R, wherein R is at least one element selected from the group consisting of Nd, Pr, Dy, Tb, and Ho, including 15 to 33% by weight of Nd, 0.1 to 10% of Co, 0.8 to 1.5% of B, 0.05 to 1.0% of Al, 0.02 to 1.0% of Cu, 0.02 to 1.0% of an element selected from Ti, Zr and Hf, 0.123 to 0.3% of C, 0.04 to 0.4% of O, 0.002 to 0.1% of N, and the balance of Fe and incidental impurities, wherein (i) at least two compounds selected from the group consisting of an M-B based compound, an M-B—Cu based compound, and an M-C based compound, wherein M is at least one metal selected from the group consisting of Ti, Zr, and Hf, and (ii) an R oxide have precipitated within the alloy, and the precipitated compounds have an average grain size of up to 5 μm and are distributed in the alloy at a maximum interval of up to 50 μm between adjacent precipitated compounds.

2. The permanent magnet material of claim 1 wherein an $R_2Fe_{14}B_i$ phase is present as a primary phase component in a volumetric proportion of 89 to 99%, and borides, carbides and oxides of rare earth or rare earth and transition metal are present in a total volumetric proportion of 0.1 to 3%.

3. The permanent magnet material of claim 1 wherein abnormally grown giant grains of $R_2Fe_{14}B_i$ phase having a grain size of at least 50 μm are present in a volumetric proportion of up to 3% based on the overall metal structure.

4. The permanent magnet material of claim 1, exhibiting magnetic properties including a remanence Br of at least 12.5 kG, a coercive force iHc of at least 10 kOe, and a squareness ratio $4\times(BH)max/Br^2$ of at least 0.95.

5. The permanent magnet material of claim 1 wherein the R—Fe—Co—B—Al—Cu system alloy contains 0.132 to 0.3% by weight of C.

6. The permanent magnet material of claim 1 wherein the R—Fe—Co—B—Al—Cu system alloy contains 0.141 to 0.3% by weight of C.

7. The permanent magnet material of claim 1 wherein the R—Fe—Co—B—Al—Cu system alloy contains 0.132 to 0.3% by weight of C.

8. The permanent magnet material of claim 1 wherein the R—Fe—Co—B—Al—Cu system alloy contains 0.141 to 0.3% by weight of C.

9. The permanent magnet material of claim 1 wherein R is at least one element selected from the group consisting of Nd, Dy, Tb, and Ho.

10. The permanent magnet material of claim 1 wherein R is Pr and at least one element selected from the group consisting of Nd, Dy, Tb and Ho, and the alloy contains 0.123 to 0.3% by weight of C.

11. The permanent magnet material of claim 1 wherein (i) all of the M-B based compound, the M-B based compound, and the M-B—Cu based compound, and the M-C based compound, wherein M is at least one metal selected from the group consisting of Ti, Zr, and Hf and (ii) the R oxide have precipitated within the alloy.

* * * * *